US007379079B2

(12) United States Patent
Kang

(10) Patent No.: US 7,379,079 B2
(45) Date of Patent: May 27, 2008

(54) ELECTRON EMISSION DEVICE AND DRIVING METHOD THEREOF

(75) Inventor: Mun-Seok Kang, Anyang-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 686 days.

(21) Appl. No.: 10/933,999

(22) Filed: Sep. 3, 2004

(65) Prior Publication Data

US 2005/0073516 A1 Apr. 7, 2005

(30) Foreign Application Priority Data

Oct. 1, 2003 (KR) ..... 10-2003-0068358

(51) Int. Cl.
*G09G 3/22* (2006.01)

(52) U.S. Cl. ..... 345/690; 345/63; 345/74.1; 345/76; 345/102; 345/204; 345/589; 315/169.3; 348/673; 349/31

(58) Field of Classification Search ..... 345/47, 345/63, 77, 89, 204, 589, 690; 313/502; 315/169.3; 348/687
See application file for complete search history.

(56) References Cited

U.S. PATENT DOCUMENTS 4,649,432 A * 3/1987 Watanabe et al. ..... 348/800
5,010,411 A * 4/1991 Shimada et al. ..... 348/799
6,147,664 A * 11/2000 Hansen ..... 345/74.1
6,597,333 B2 * 7/2003 Todoroki et al. ..... 345/63
6,816,676 B2 * 11/2004 Bianchi et al. ..... 396/282
2003/0016189 A1 * 1/2003 Abe et al. ..... 345/55
2003/0085905 A1 * 5/2003 Mori et al. ..... 345/589
2003/0107681 A1 * 6/2003 Otawara et al. ..... 348/673
2003/0231195 A1 * 12/2003 Ueno et al. ..... 345/698
2004/0008176 A1 * 1/2004 Nuimura ..... 345/102

* cited by examiner

*Primary Examiner*—Bipin Shalwala
*Assistant Examiner*—Vincent E. Kovalick
(74) *Attorney, Agent, or Firm*—Christie, Parker & Hale, LLP

(57) ABSTRACT

An electro emission device (EED) operated by a driver for modulating the pulse width of a driving pulse according to a pulse width modulation (PWM) clock signal to control the brightness of images. The EED calculates a brightness level of image data indicating the brightness of the whole image for each unit image of a video signal. The image data is stored for each unit image of the video signal. The reference brightness level stored in the look-up table is compared with a calculated brightness level to determine a signal of the PWM clock signal condition. A PWM clock signal is generated according to the signal of the PWM clock signal condition to drive the display panel based on the PWM clock signal.

14 Claims, 6 Drawing Sheets

ELECTRON EMISSION DEVICE AND DRIVING METHOD THEREOF

CROSS REFERENCE TO RELATED APPLICATION

This application claims priority to and the benefit of Korea Patent Application No. 2003-68358 filed on Oct. 1, 2003 in the Korean Intellectual Property Office, the content of which is incorporated herein by reference.

BACKGROUND OF THE INVENTION (a) Field of the Invention

The present invention relates to an electron emission device. More specifically, the present invention relates to a display device using a field emitter array.

(b) Description of the Related Art

Generally, there are two kinds of electron emission device (EED). One uses a thermionic cathode as an electron source and the other uses a cold cathode as an electron source. Also, in the EED using a cold cathode, there are the field emitter array (FEA) type, the surface conduction emitter (SCE) type, metal-insulator-metal (MIM) or metal-insulator-semiconductor (MIS) type, and ballistic electron surface emitting (BSE) type.

In particular, the EED is being considered as a next-generation display because it uses light emission of fluorescent bodies by electron beams as does the cathode ray tube (CRT) to have the excellent characteristics of the CRT and to realize a flat panel display of low power consumption without any image distortion. It also has some satisfactory characteristics with regard to large viewing angle, fast response time, high brightness, high contrast, and small panel thickness.

The typical EED is composed of a triode structure having cathode, anode, and gate electrodes. More specifically, the cathode electrode that is generally used as a data electrode is formed on a substrate. An insulation layer having a contact hole and the gate electrode generally used as a scan electrode are integrated on the insulation layer. Additionally, an emitter used as an electron source is formed inside the contact hole and is connected to the cathode electrode. Alternatively, the gate electrode can be a data electrode and the cathode electrode can be a scan electrode. That is, a cathode electrode can be one of a scan electrode and a data electrode, and a gate electrode can be the other according to structure of the EED.

The EED of this structure concentrates a high electric field on the sharp-tip cathode, that is, the emitter, to emit electrons by the quantum-mechanical tunneling effect, which electrons are accelerated by a cathode-anode voltage and collide with red (R), green (G), and blue (B) fluorescent films formed on both electrodes to emit light from the fluorescent body and to display an image.

The brightness of the image formed from light emission of fluorescent bodies as caused by collision of the emitted electrons with the fluorescent film changes according to the value of an input digital video signal. More specifically, the value of the digital video signal is composed of 8-bit RGB data, i.e., $0(00000000_{(2)})$ to $255(11111111_{(2)})$, which 256 digital values realize 256-gray-scale representation and color brightness.

Pulse width modulation (PWM) or pulse amplitude modulation (PAM) is generally used to control the brightness represented by the value of the digital video signal.

PWM is a technique to modulate the pulse width of driving pulses applied to display input image data according to counted clock signals output from a driving IC, to achieve gray scale representation. In PWM, the number of counted clock signals is equal to the total number of gray scale levels, and in most cases, 8-bit signals are input to realize a 256-gray-scale full color image.

The time required for generating the total number of counted clock signals is the on-time applied to the display panel through a data electrode. For counted clock signals of an even-spacing cycle, driving pulses of the same pulse width for all data of 0 to 255-gray levels are applied. For counted clock signals of a non-even-spacing cycle, for example when the spacing width is increased in the low gray scale level and decreased in the high gray scale level, the pulse width of the driving pulse by gray scale levels increases in a part of the input image data of a low gray scale level but decreases in a part of the input image data of a high gray scale level. Hence, the low gray scale of the data is better represented on the actual display panel to enhance the ability of brightness representation according to the gray scale on the dark image.

In this conventional PWM method, the cycle of counted clock signals is constant irrespective of input image data because no information is provided about the counted clock signals of which cycle must be raised among the gray scale levels of 0 to 255. This makes it impossible to effectively control brightness according to the input image data.

SUMMARY OF THE INVENTION

In accordance with the present invention an EED and a driving method thereof is provided for actively changing the cycle of PWM clock signals according to the characteristic of input image data.

In one exemplary embodiment of the present invention, there is provided an EED which is operated by a driver for modulating the pulse width of a driving pulse according to a pulse width modulation (PWM) clock signal to control brightness. The EED includes: a calculator for calculating a brightness level of image data indicating the brightness of a whole image for each unit image of a video signal. A memory stores the image data for each unit image of the video signal. A comparator calculates a signal of the PWM clock signal condition based on the brightness level from the calculator. A PWM clock signal generator generates a PWM clock signal according to the signal of the PWM clock signal condition and transmits the generated PWM clock signal to the driver.

The unit image is a one-frame image and the memory is a frame memory. Alternatively, the unit image may be a one-line image and the memory a line memory.

The calculator includes a summator for summating the image data for each unit image and a divider for calculating an average of the output of the summator.

The signal of the PWM clock signal condition includes signal Clk_num for determining the number of multiplications of the clock signal, start signal Start_num for determining a start position of each multiplication interval and end signal End_num for determining an end position of each multiplication interval.

The signal of the PWM clock signal condition is a signal for determining the type of PWM clock signal. The PWM clock signal generator stores a PWM clock signal corresponding to each signal of the PWM clock signal condition, and determines the type of corresponding PWM clock signal according to the signal of the PWM clock signal condition output from the comparator.

The comparator further includes a look-up table storing a reference brightness level of the video signal and signals of the PWM clock signal conditions according to the reference brightness level.

In another exemplary embodiment of the present invention, there is provided a method for driving an EED, which modulates a pulse width of a driving pulse according to a PWM clock signal to control brightness. The method includes: (a) storing image data for each unit image of a video signal; (b) calculating a brightness level of image data indicating the brightness of a whole image for each unit image of the video signal; (c) calculating a signal of the PWM clock signal condition according to the brightness level; (d) generating a PWM clock signal according to the signal of the PWM clock signal condition; and (e) displaying the image according to the converted image data.

The unit image is a one-frame image or a one-line image.

The step (b) includes: summating the image data for each unit image; and calculating an average of the summation result.

The step (a) continues during the steps (b) and (c).

DETAILED DESCRIPTION

Figure 1:
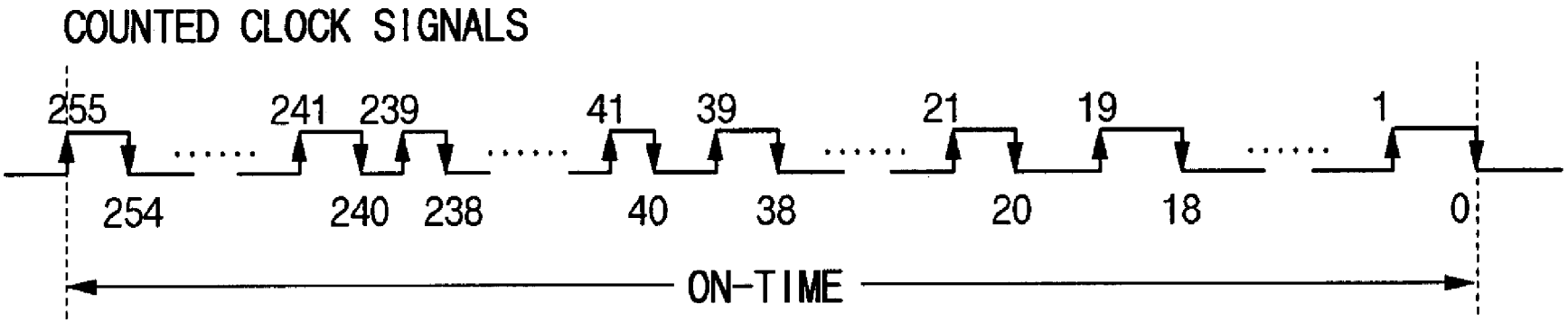
FIG. 1 shows an example of counted clock signals used in the PWM method, and on-time.

Referring to FIG. 1, the count clock signals that cover a full gray scale range of 255 to 0 have different cycles by gray scales. More specifically, the cycle of the counted clock signals is longer for minimum and maximum gray scales than for the middle one. Hence, the driving pulses generated by the counted clock signals increase the brightness difference in representation of high and low gray scales to enhance a gray scale representation.

Figure 2:
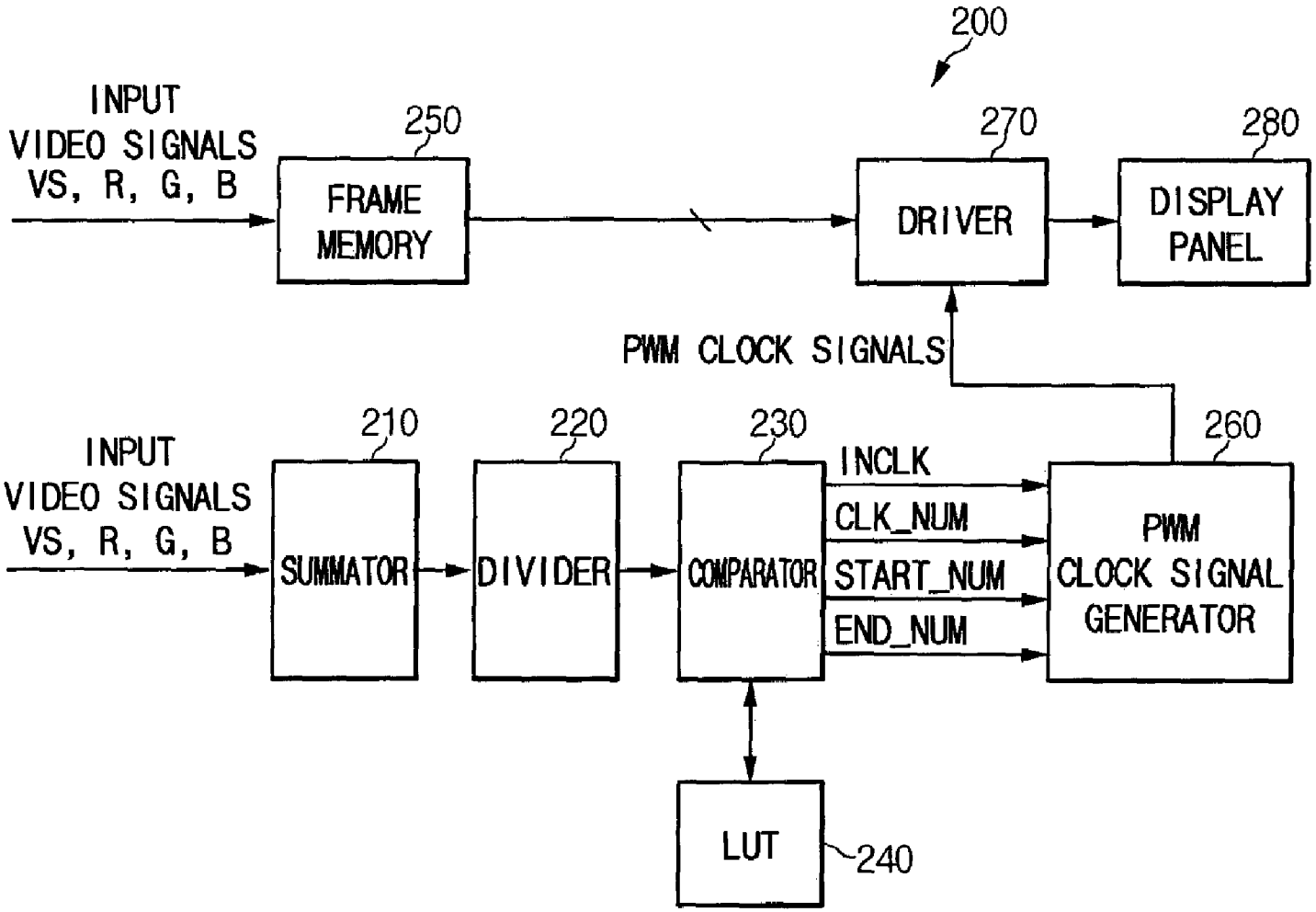
FIG. 2 is a schematic of an FED according to a first embodiment of the present invention.

FIG. 2 is a schematic of an FED according to a first embodiment of the present invention. FED 200 of FIG. 2 is a device that changes the cycles of the counted clock signals according to frame-based image data. FED 200 includes summator 210 for summating input video signals in frame units; divider 220 for calculating an average brightness level in frame units; look-up table (LUT) 240 for storing a reference brightness level indicating the brightness of an image to be displayed and conditions for generating PWM clock signals according to the brightness level; comparator 230 for comparing the average brightness level calculated by divider 220 with the reference brightness level of LUT 240 to determine the signal of the PWM clock signal condition and to generate signals of the PWM clock signal condition; frame memory 250 for storing the input video signals in frame units; PWM clock signal generator 260 for generating PWM clock signals according to the result of the comparison; driver 270 for driving a display panel; and display panel 280.

Summator 210 receives video signals and vertical synchronous signal VS to calculate the data capacity of the video signals in frame units. Summator 210 summates one frame, i.e., 8-bit RGB data in the active interval of one vertical synchronous signal VS. The resultant value of the summation is sent to divider 220 that calculates the average in units of one frame.

When divider 220 calculates the average of the 8-bit RGB data, the average indicates the brightness of the video signals to be displayed. Namely, a large data capacity of the average calculated by divider 220 means that the image is entirely bright, and a small data capacity means that the image is relatively dark.

LUT 240 stores signals of the PWM clock signal conditions by the respective levels of the average of the reference brightness levels of the video signal data and the brightness of the image based on the average. Otherwise, LUT 240 is not separately provided but is logically implemented in comparator 230.

Comparator 230 receives the brightness information of the image calculated for a specific frame by divider 220, i.e., the average brightness level, and compares it with the reference brightness level stored in LUT 240. Comparator 230 also outputs, to PWM clock signal generator 260, signals of the PWM clock signal condition for PWM clock signal generation, i.e., signal Clk_num determining the number of multiplications of Inclk, and start signal Start_num and end signal End_num determining the start and end positions of each multiplication interval, respectively.

Upon receiving the respective signals from comparator 230, PWM clock signal generator 260 multiplies signal Inclk by the value of signal Clk_num to generate a transformed clock signal, and allocates the transformed clock signal to an interval corresponding to the start signal and Start_num and end signal End_num of the original PWM clock signal to generate PWM clock signals differentiated for every interval.

Figure 3A:
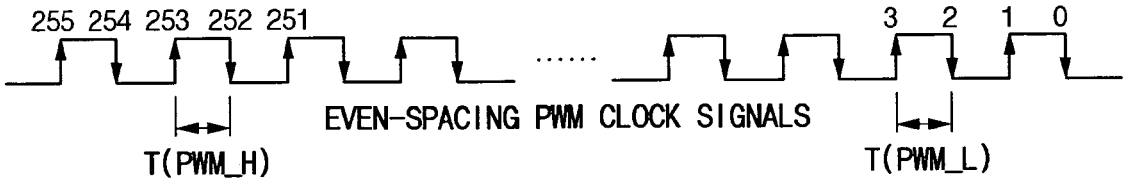
FIGS. 3*a*-3*c* show PWM clock signals generated from a PWM clock signal generator.
Figure 3B:
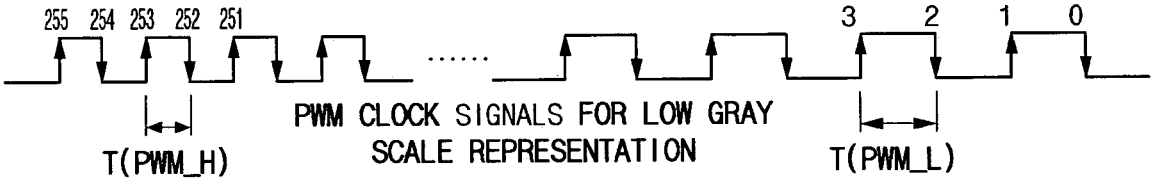
Figure 3C:
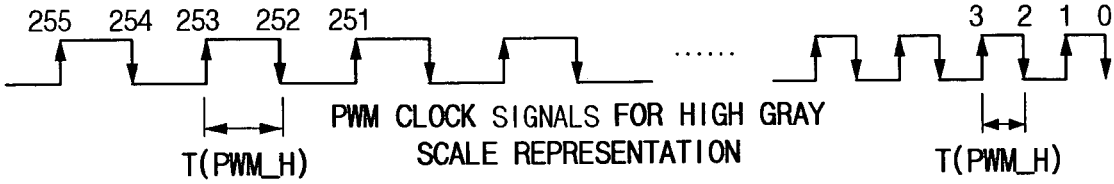

FIGS. 3*a*-3*c* show various PWM clock signals generated from PWM clock signal generator 260. FIG. 3(*a*) shows an even-spacing PWM clock signal. In FIG. 3(*a*), the even-spacing PWM clock signal has the same pulse width for high and low gray scales T(PWM_H) and T(PWM_L), i.e., T(PWM_H)=T(PWM_L), so the 0-255 gray scale levels are the same. FIG. 3(*b*) shows a PWM clock signal for gray scale representation of a low-gray-scale image. The PWM clock signal for low gray scale representation satisfies T(PWM_H)<T(PWM_L). FIG. 3(*c*) shows a PWM clock signal for gray scale representation of a high-gray-scale image. The PWM clock signal for high gray scale representation satisfies T(PWM_H)>T(PWM_L).

In this way, the cycle of the PWM clock signal is wide in the low gray scale range and narrow in the high gray scale range in FIG. 3(*b*), but wide in the high gray scale range and narrow in the low gray scale range in FIG. 3(*c*), so as to achieve the same 256-gray-scale representation irrespective of the gray scale level of the image to be displayed. However, the total time of the PWM clock signal is the same, which realizes "on-time" applied to the display panel through the data electrode.

The PWM clock signal generated by PWM clock signal generator 260 is output based on the brightness level of the input image data and is applied to the corresponding frame data to represent the gray scale of the input image. Hence, the gray scale level can be actively adjusted according to the input video signals to raise low gray scale representation for a low-brightness image and high gray scale representation for a high-brightness image.

Figure 4:
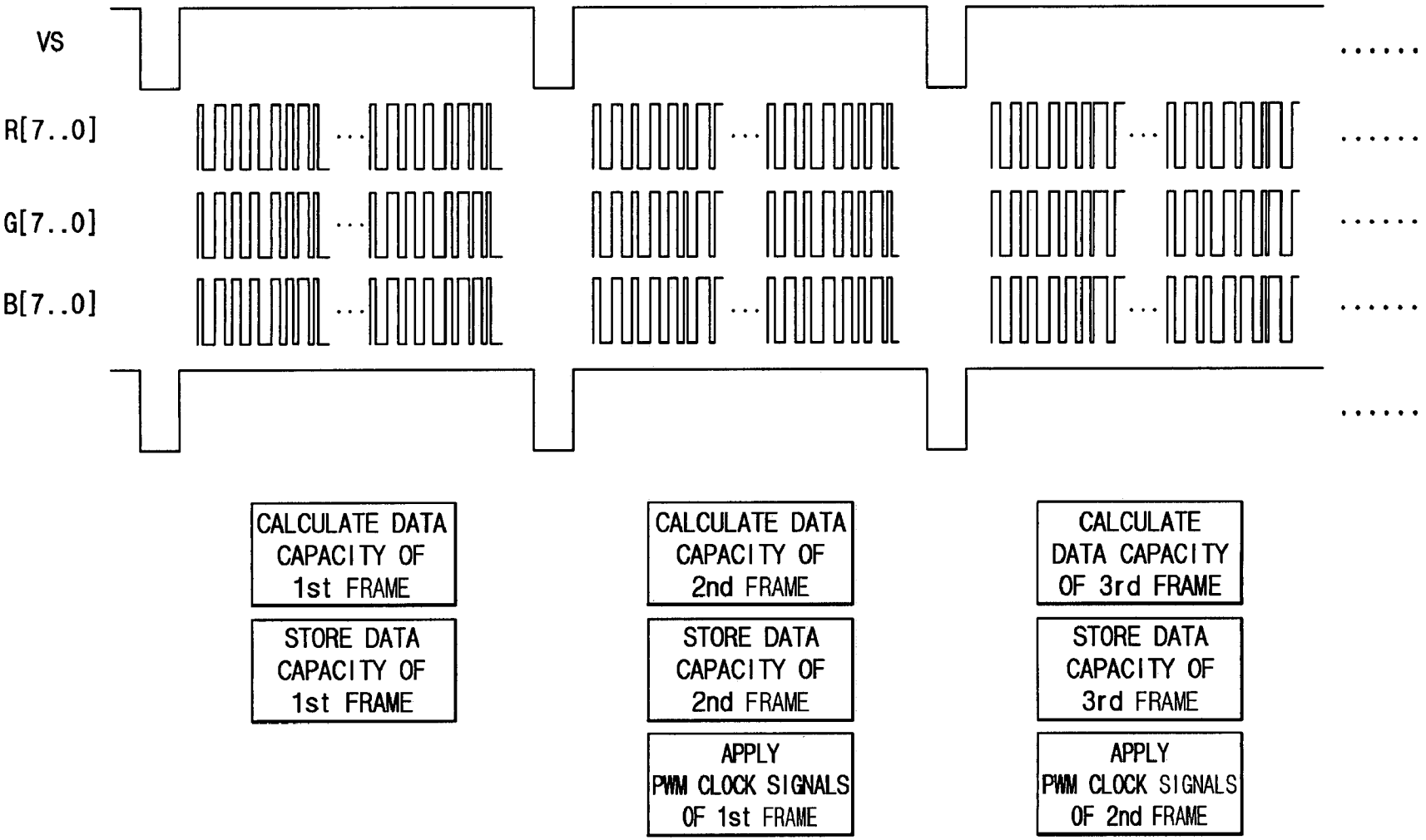
FIG. 4 is a timing diagram for generating PWM clock signals according to frame-based image data and applying the generated PWM clock signals.

FIG. 4 is a timing diagram for generating PWM clock signals according to frame-based image data and applying the generated PWM clock signals. As shown in FIG. 4, 8-bit RGB data corresponding to the first frame are applied to the first active interval of frame-discriminating vertical synchronous signal VS. In the first active interval, summator 210 summates the image data corresponding to the first frame and divider 220 calculates the average of the image data. Also, comparator 230 compares the average with the reference brightness level of LUT 240 in the first active interval to determine signals of the PWM clock signal conditions and to generate signal Clk_num determining the number of multiplications of Inclk, and to start signal Start_num and end signal End_num determining the start and end positions of each multiplication interval, respectively. PWM clock signal generator 260 generates PWM clock signals based on the signals received from comparator 230. The video signal data of the first frame are stored in frame memory 250 at the same time of the first-frame data processing.

In the second active interval of vertical synchronous signal VS, summator 210 summates the image data corresponding to the second frame and divider 220 calculates the average of the image data. Also, comparator 230 compares the average with the reference brightness level of LUT 240 in the second active interval to determine signals of the PWM clock signal conditions and to generate signal Clk_num determining the number of multiplications of Inclk and start and end signals Start_num and End_num determining the start and end positions of each multiplication interval, respectively. PWM clock signal generator 260 generates PWM clock signals based on the signals received from comparator 230. The video signal data of the second frame are stored in frame memory 250 at the same time of the second-frame data processing.

During the second active interval of vertical synchronous signal VS, driver 270 receives the image data of the first frame stored in frame memory 250 and the PWM clock signals of the first frame generated from PWM clock signal generator 260 in the first active interval and applies the PWM clock signals of the first frame for the image data of the first frame.

To represent the gray scale of the corresponding frame while the PWM clock signals are output based on the calculation of the input image data, there occurs a delay of as long as the first active interval of the vertical synchronous signal, as shown in FIG. 4.

The PWM clock signals generated differentially by the respective intervals in this way are used to maintain the emission current in even-spacing intervals and to harmonize the display with the human visual perceptional characteristic.

Figure 5:
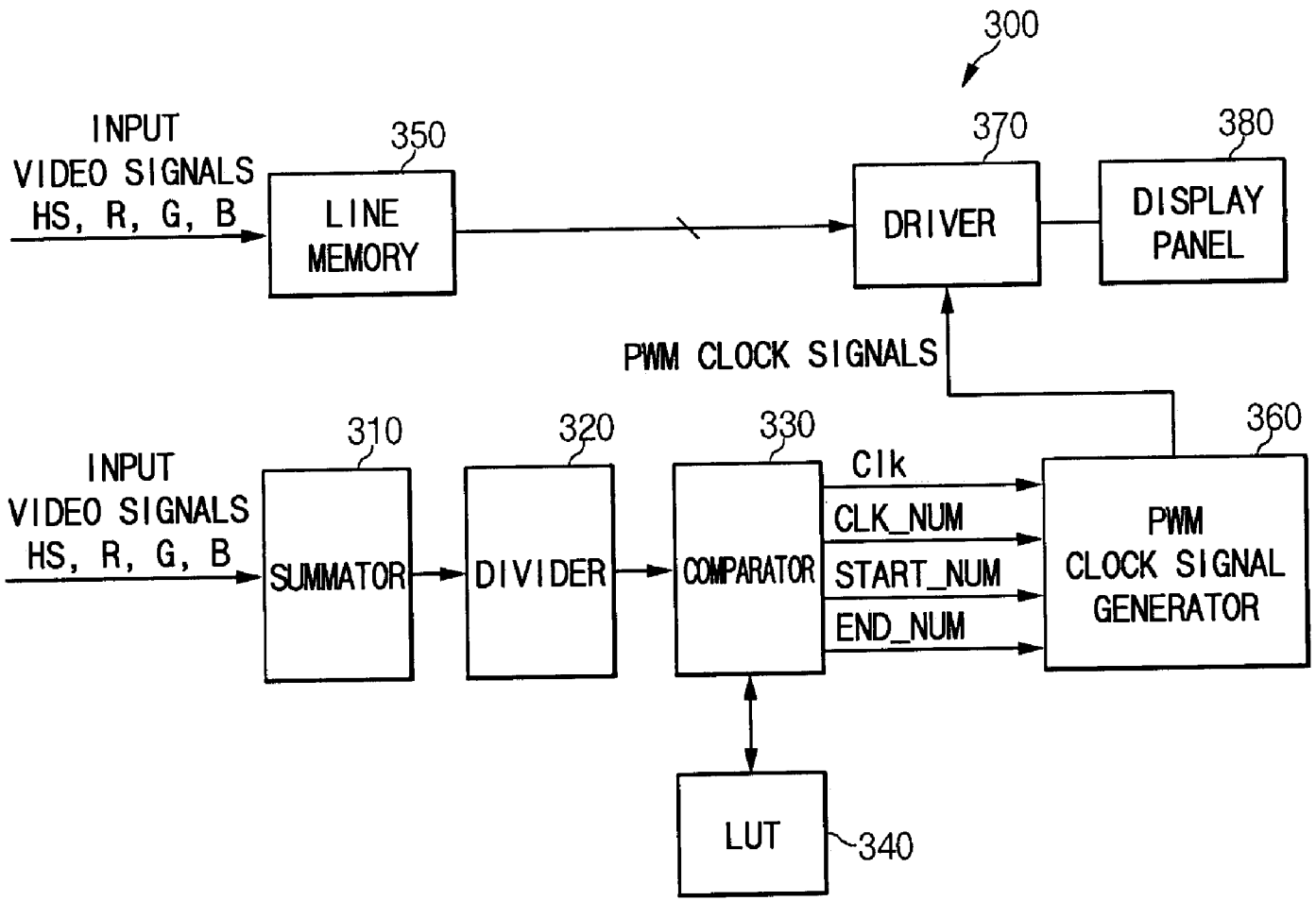
FIG. 5 is a schematic of an FED according to a second embodiment of the present invention.

FIG. 5 is a schematic of an FED according to a second embodiment of the present invention. Hereinafter, a second embodiment of the present invention will be described in detail with reference to FIG. 5. For simplicity of description, the same parts as in the first embodiment will be omitted.

FED 300 includes summator 310 for summating input video signals in line units; divider 320 for calculating an average brightness level in line units; LUT 340 for storing a reference brightness level indicating the brightness of an image to be displayed and signals of the PWM clock signal condition according to each brightness level; comparator 330 for comparing the average brightness level calculated by divider 320 with the reference brightness level of LUT 340 to generate signals of the PWM clock signal condition; line memory 350 for storing the input video signals in line units; PWM clock signal generator 360 for generating PWM clock signals according to the result of the comparison; driver 370 for driving a display panel; and display panel 380.

Summator 310 receives video signals and horizontal synchronous signal HS. To calculate the data capacity of the video signals in line units, summator 310 summates one line, i.e., 8-bit RGB data in the active interval of one horizontal synchronous signal HS. The resultant value of the summation is sent to divider 320 that calculates the average in units of one frame.

Divider 320 calculates the average of the 8-bit RGB data. The average indicates the brightness of the video signals to be displayed. Namely, a large data capacity of the average calculated by divider 320 means that the image is entirely bright, but a small data capacity means that the image is relatively dark.

LUT 340 stores signals of the PWM clock signal condition by the respective levels of the average of the reference brightness levels of the video signal data and the brightness of the image based on the average. Otherwise, LUT 340 is not separately provided but is logically implemented in comparator 330.

Comparator 330 receives the brightness information of the image calculated for a specific line by divider 320 and compares it with the reference brightness level stored in LUT 340. Comparator 330 also outputs signals of the PWM clock signal condition to PWM clock signal generators 360 so as to generate signals of the PWM clock signals according to the PWM clock signal condition.

PWM clock signal generator 360, which stores the type of PWM clock signal corresponding to each signal Clk, receives output signal Clk of comparator 330 to generate a PWM clock signal corresponding to input signal Clk of the PWM clock signal condition and outputs the generated PWM clock signal to driver 370.

PWM clock signals of the same type as in FIG. 3 are generated in the second embodiment.

Figure 6:
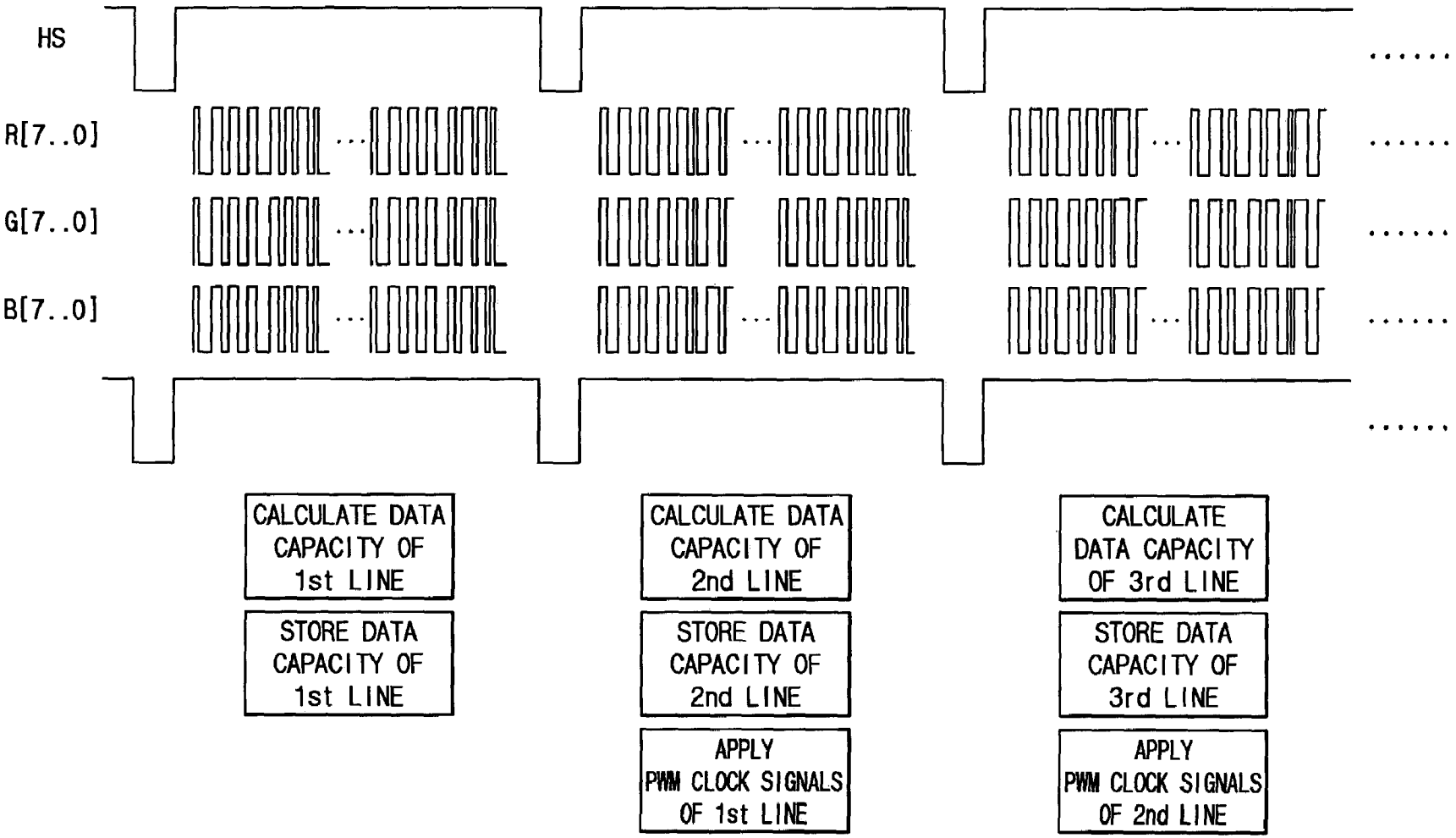
FIG. 6 is a timing diagram for generating PWM clock signals according to line-based image data and applying the generated PWM clock signals.

FIG. 6 is a timing diagram for generating PWM clock signals according to line-based image data and applying the generated PWM clock signals. As shown in FIG. 6, 8-bit RGB data corresponding to the first line are applied to the first active interval of line-discriminating horizontal synchronous signal HS. In the first active interval, summator 310 summates the image data corresponding to the first line and divider 320 calculates the average of the image data. Also, comparator 330 compares the average with the reference brightness level of LUT 340 in the first active interval to generate first signal Clk of the PWM clock signal condition. PWM clock signal generator 360 generates PWM clock signals according to first signal Clk of the PWM clock signal condition and outputs them to driver 370. The video signal data of the first line are stored in line memory 350 at the same time of the first-line data processing.

In the second active interval of horizontal synchronous signal HS, summator 310 summates the image data corresponding to the second line and divider 320 calculates the average of the image data. Also, comparator 330 compares the average with the reference brightness level of LUT 340 in the second active interval to generate second signal Clk of the PWM clock signal condition. PWM clock signal generator 360 generates PWM clock signals according to second signal Clk of the PWM clock signal condition and outputs them to driver 370. The video signal data of the second line are stored in line memory 350 at the same time of the second-line data processing.

During the second active interval of horizontal synchronous signal HS, driver 370 receives the image data of the first line stored in line memory 350 and the PWM clock signals of the first line generated from PWM clock signal generator 360 in the first active interval and applies the PWM clock signals of the first line for the image data of the first line.

To calculate the image data of each line to be displayed and apply the PWM clock signal to the corresponding line according to the result of the calculation, the image data of each line are stored in the line memory during the calculation and are output from the line memory as the PWM clock signal of the corresponding line is output, so the PWM clock signal is applied to the corresponding image data. Namely, the image data are delayed for as long as one active interval of the horizontal synchronous signal.

FED 300 according to the second embodiment of the present invention achieves the same effects as FED 200 according to the first embodiment.

While this invention has been described in connection with what is presently considered to be practical and exemplary embodiments, it is to be understood that the invention is not limited to the disclosed embodiments, but, on the contrary, is intended to cover various modifications and equivalent arrangements included within the spirit and scope of the appended claims.

In accordance with the present invention, information of an input image is calculated in frame or line units to obtain the brightness information of the image to be actually displayed. So, PWM clock signals for increasing the cycle of the counted clock signal corresponding to a high gray scale are generated so as to effectively represent high gray scale in case of a bright image. Contrarily, PWM clock signals for reducing the cycle of the counted clock signal corresponding to a low gray scale are generated to effectively represent low gray scale in a dark image.

In this way, the PWM clock signal differentially generated for the respective intervals is used to maintain an emission current at a constant interval, as a result of which it is possible to represent gray scales having a constant brightness difference irrespective of the nonlinearity of the emission current generated by the applied voltage in actual realization of the image and to harmonize the difference between the display and the human visual perceptional characteristic.

What is claimed is:

1. An electro emission device operated by a driver for modulating a pulse width of a driving pulse according to a pulse width modulation clock signal to control brightness, the electro emission device comprising:

a calculator for calculating a brightness level of image data and providing a brightness level output indicating the brightness of a whole image for each unit image of a video signal;

a memory for storing image data for each unit image of the video signal;

a comparator for calculating a signal of a pulse width modulation clock signal condition based on the brightness level output from the calculator; and a pulse width modulation clock signal generator for generating a pulse width modulation clock signal according to the signal of the pulse width modulation clock signal condition and outputting the generated pulse width modulation clock signal to the driver, wherein the signal of the pulse width modulation clock signal condition is a signal for determining the type of the pulse width modulation clock signal.

2. The electro emission device as claimed in claim 1, wherein the unit image is a one-frame image.

3. The electro emission device as claimed in claim 2, wherein the memory is a frame memory.

4. The electro emission device as claimed in claim 2, wherein the calculator comprises:

a summator for summating the image data for each unit image; and a divider for calculating an average of an output of the summator.

5. The electro emission device as claimed in claim 2, wherein the signal of the pulse width modulation clock signal condition comprises:

a signal for determining a number of multiplications of the clock;

a start signal for determining a start position of each multiplication interval; and an end signal for determining an end position of each multiplication interval.

6. The electro emission device as claimed in claim 2, wherein the pulse width modulation clock signal generator stores a pulse width modulation clock signal corresponding to each signal of the pulse width modulation clock signal condition and determines the type of the corresponding pulse width modulation clock signal according to the signal of the pulse width modulation clock signal condition output from the comparator.

7. The electro emission device as claimed in claim 1, wherein the unit image is a one-line image.

8. The electro emission device as claimed in claim 7, wherein the memory is a line memory.

9. The electro emission device as claimed in claim 1, wherein the comparator further comprises:

a lookup table storing a reference brightness level of the video signal and signals of the pulse width modulation clock signal conditions according to the reference brightness level.

10. A method for driving an electro emission device which modulates a pulse width of a driving pulse according to a pulse width modulation clock signal to control brightness, the method comprising:

(a) storing image data for each unit image of a video signal;

(b) calculating a brightness level of image data indicating the brightness of a whole image for each unit image of the video signal;

(c) calculating a signal of a pulse width modulation clock signal condition according to the brightness level;

(d) generating a pulse width modulation clock signal according to the signal of the pulse width modulation clock signal condition; and (e) displaying the image according to the pulse width modulation clock signal corresponding to the signal of the pulse width modulation clock signal condition, wherein the signal of the pulse width modulation clock signal condition is a signal for determining the type of the pulse width modulation clock signal.

11. The method as claimed in claim 10, wherein the unit image is a one-frame image.

12. The method as claimed in claim 10, wherein the unit image is a one-line image.

13. The method as claimed in claim 10, wherein the step (b) comprises:

summating the image data for each unit image; and calculating an average of the summation result.

14. The method as claimed in claim 10, wherein the step (a) continues during the steps (b) and (c).

* * * * *